US005330001A

United States Patent [19]

Baugh et al.

[11] Patent Number: 5,330,001

[45] Date of Patent: Jul. 19, 1994

[54] LEAD IN GUIDE ASSEMBLY

[75] Inventors: John L. Baugh, Houston; George J. Melenyzer, Humble, both of Tex.; James Peterson, Gretna, La.

[73] Assignee: Baker Hughes Incorporated, Houston, Tex.

[21] Appl. No.: 979,620

[22] Filed: Sep. 23, 1992

[51] Int. Cl.[5] ..... E21B 23/02

[52] U.S. Cl. ..... 166/138; 166/241.6

[58] Field of Search ..... 166/241.1, 241.2, 241.3, 166/241.4, 241.5, 241.6, 50, 85, 138, 217, 382

[56] References Cited

U.S. PATENT DOCUMENTS

| | | | |
|---|---|---|---|
| 2,333,348 | 11/1943 | Tucker | 166/241.6 |
| 2,769,499 | 11/1956 | McKissick et al. | 166/138 |
| 2,776,012 | 1/1957 | Baker | 166/138 |
| 2,806,536 | 9/1957 | Baker et al. | 166/138 |
| 2,909,226 | 10/1959 | Stohn | 166/138 |
| 3,002,562 | 10/1961 | Carothers | 166/138 |
| 3,186,489 | 6/1965 | Farrar et al. | 166/138 |
| 3,189,096 | 6/1965 | Phenix | 166/138 |
| 3,338,308 | 8/1967 | Elliston et al. | 166/138 |
| 3,409,085 | 11/1968 | Oliver | 166/138 |
| 4,513,817 | 4/1985 | Weinberg . | |

*Primary Examiner*—Ramon S. Britts
*Assistant Examiner*—Frank S. Tsay
*Attorney, Agent, or Firm*—Charles D. Gunter, Jr.

[57] ABSTRACT

A lead-in guide assembly is shown for centralizing a downhole tool being run from a well surface within a well bore to a selected downhole location. The lead-in guide can be utilized as a seal assembly guide including a seal carrier provided with a leading end and a trailing end which is made up in a tubing string leading to the well surface. A collapsible guide is located at the leading end of the seal carrier for centralizing the seal carrier within the surrounding cased well bore as the seal assembly is being run into position above a cooperating sealing bore located at a downhole location. The guide means moves to a retracted position as the assembly moves within the cooperating sealing bore.

12 Claims, 3 Drawing Sheets

LEAD IN GUIDE ASSEMBLY

BACKGROUND OF THE INVENTION

1. Field of the Invention

The present invention relates generally to downhole tools run within a subterranean well bore from the well surface during the drilling, completion and production of oil and gas wells and, more specifically, to an improved mechanism for protecting the component parts of such tools during the running-in of such tools to a selected depth within the well bore.

2. Description of the Prior Art

A large number of downhole tools are used in the oil and gas industries which must be lowered from the well surface to a selected location within the well bore. Many of these downhole tools have component parts which are fragile, or which otherwise need protection from scraping, jarring or otherwise impacting the surrounding cased or uncased well bore during the running-in operation. For example, commonly used downhole tools which require the provision of a seal in the annular area located between a fluid transmission conduit, or other tubing string, and a surrounding conduit such as the outer well casing. Such tools may be employed in the drilling and completion of the well, the production of the well, the servicing of the well, or the closing-in of a well. Conventional packers utilize an anchoring system which holds a sealing element in position against other upwardly or downwardly acting pressure differentials in order to establish such an annular seal. Such conventional packers typically employ radially extendible gripping slip systems and radially expandable packing or sealing elements to prevent fluid communication and to provide pressure integrity. Such packers are typically run-in to position within the well bore and set either on a tubing string or on a wireline setting tool. Those packers which are set on a tubing string are typically set using hydraulic pressure within the tubing, hydrostatic pressure in the well bore, or a combination of both. Such packers may also be mechanically set by the application of the force or weight to the tubing string. Permanent packers of the above type include an internal seal bore for receiving tubing which can be retrieved while leaving the packer in place. Retrievable packers utilize such techniques as rotation of the tubing string to release the gripping slip assemblies and packing elements for retrieval of the packing element.

During the above described operations, it is generally necessary that sealing integrity be established between separate elements within the tubing string or between accessory items and the tubing string. Thus, it is generally necessary where a tubing section is inserted into the seal bore of the packer to establish sealing integrity between that section and the packer. One means of providing such sealing integrity is to utilize stacks of sealing elements in which individual sealing elements have a generally chevron-shaped cross-section. Such sealing systems employing chevron-shaped sealing elements are shown, for example on page 62 of the 1990 Baker Service Tools Catalog. These chevron-shaped sealing elements and systems are commonly referred to as tieback accessories or tubing seal systems and are generally employed to establish a seal between a tubing mounted element and the internal seal bore of a conventional packer.

Another method for providing sealing integrity in the tubing casing annulus and to isolate the production zone from portions of the annulus extending above the packing element is to utilize a polished seal bore receptacle in conjunction with sealing elements. Such a seal assembly is again shown on page 62 of the Baker Service Tools 1990 Catalog as the "PBR Tieback Seal Assembly." Such sealing assemblies used in conjunction with polished seal bore receptacles provide a tubing to casing annular seal and permit isolation of the production zone from the tubing-casing annulus. These assemblies can be positioned precisely at a desired location in the casing and permit tubing movement which may result during a production or treating cycle.

There are other advantages associated with the use of seal assemblies of the above type as compared to conventional radially expanding packing elements. Thus, the sealing function can be achieved with a cross-sectional area or gap across which the sealing elements must bridge being much less than that encountered with conventional packing elements. Significant radial expansion of the sealing elements is not required. Also, whereas conventional radially expanding packing elements require a more complicated means of expanding the packing element into sealing relationship, the elements of the tubing seal systems are energized by the pressure which they contain. Thus, they do not need a mechanism to expand them or retain them in sealing relationship.

One problem associated with the use of existing tubing seal assemblies involves damage to the seal means carried on the tubular seal carrier during the running-in operation from the well surface into the polished seal bore receptacle located at the downhole location. The prior art assemblies have not utilized a centralizing device other than a top, stationary gauge ring. Such designs exposed the seals, whether metal-to-metal or elastomeric, to mechanical damage while running into position within the well bore.

The present invention has as its object to provide an improved mechanism for protecting downhole tools during the running-in of such tools from the well surface to a selected downhole location within the well bore or for preventing the premature actuation of such tools during the running-in operation.

In one preferred embodiment, the present invention has as its object to provide a lead-in guide for centralizing a seal assembly being run from a well surface within a well bore to a cooperating sealing bore located at a downhole location.

Another object of the invention is to provide a seal assembly guide for centralizing a packoff seal assembly being run from a well surface within a cased well bore to a cooperating casing or receptacle defining a polished bore surface located at a downhole location.

SUMMARY OF THE INVENTION

The lead-in guide assembly of the invention is used to centralize a downhole tool being run from a well surface to a selected downhole location. The lead-in guide includes a tubular carrier having an interior and having an exterior surface defined between a leading end and a trailing end thereof. The trailing end is adapted to be made up in a tubing string leading to the well surface. The tubular carrier also has fragile components on the exterior surface thereof. Collapsible guide means are located in the leading end of the tubular carrier for centralizing the carrier within the surrounding well bore as the tubular carrier is being lowered from the well surface. The guide means collapse once the desired depth is reached within the well bore.

In one embodiment of the invention, the lead-in guide centralizes the leading end of a seal assembly being run from a well surface within a well bore to a cooperating sealing bore located at a downhole location. The guide assembly includes a tubular seal carrier having abutting means for locating the seal carrier at the desired depth within the cooperating sealing bore and has external seal means for establishing sealing integrity with the cooperating sealing bore. The tubular seal carrier has a leading end and a trailing end which is adapted to be made up in a tubing string leading to the well surface. A collapsible guide means is located at the leading end of the tubular seal carrier for centralizing the seal carrier within the surrounding well bore. The guide means is collapsible between an expanded, running-in position while above the sealing bore and a retracted position within the cooperating sealing bore.

Preferably, the lead-in guide assembly is used to centralize a packoff seal assembly being run from a well surface within a cased well bore to a cooperating sealing bore receptacle defining a polished seal bore surface located at the downhole location. The tubular seal carrier of the assembly has a downwardly facing shoulder for locating the seal carrier with respect to a cooperable upwardly facing shoulder on the sealing bore receptacle. The seal carrier has external seal means for establishing sealing integrity with the polished seal bore surface. The tubular seal carrier has a leading end and has a trailing end adapted to be made up in the tubing string leading to the well surface. Collapsible guide means are located at the leading end of the tubular seal carrier for centralizing the seal carrier within the surrounding cased well bore as the tubular seal carrier is being lowered from the well surface. The guide means is collapsible between an expanded, running-in position while above the sealing bore receptacle and a retracted position within the polished seal bore surface.

The collapsible guide means can comprise a plurality of radially moveable guide dogs which are located at the leading end of the tubular seal carrier within window openings provided therein. The guide dogs are radially shiftable between the expanded and retracted positions upon axial movement of the tubular seal carrier within the polished seal bore surface of the sealing bore receptacle. The guide dogs are selectively sized to be closely received within the surrounding cased well bore with at least selected guide dogs making contact with the surrounding cased well bore during the running-in operation in order to centralize the downhole tool within the cased well bore. The dogs are moved to the retracted position upon contact with the upwardly facing shoulder on the sealing bore receptacle.

Additional objects, features and advantages will be apparent in the written description which follows.

DETAILED DESCRIPTION OF THE INVENTION

The lead-in guide assembly of the invention can be used with any downhole tool having fragile components on an extended surface thereof The term "fragile" for purposes of the present discussion, is meant to encompass not only elastomeric sealing components, but also actuating mechanisms, and the like, which could be prematurely actuated by contact with the surrounding well bore or casing during the running-in operation. A variety of downhole tools compatible with the lead-in guide assembly of the invention will be readily apparent to those skilled in the relevant art. For example, in the case of subsea tubing hangers, the hanger must be guided through the blow out preventer and well head. With various hanger and slip gripping mechanisms used in completion and production equipment, the latch mechanism or gripping mechanism can benefit from being protected from impact with the surrounding well casing, thereby preventing premature setting.

Figure 1:
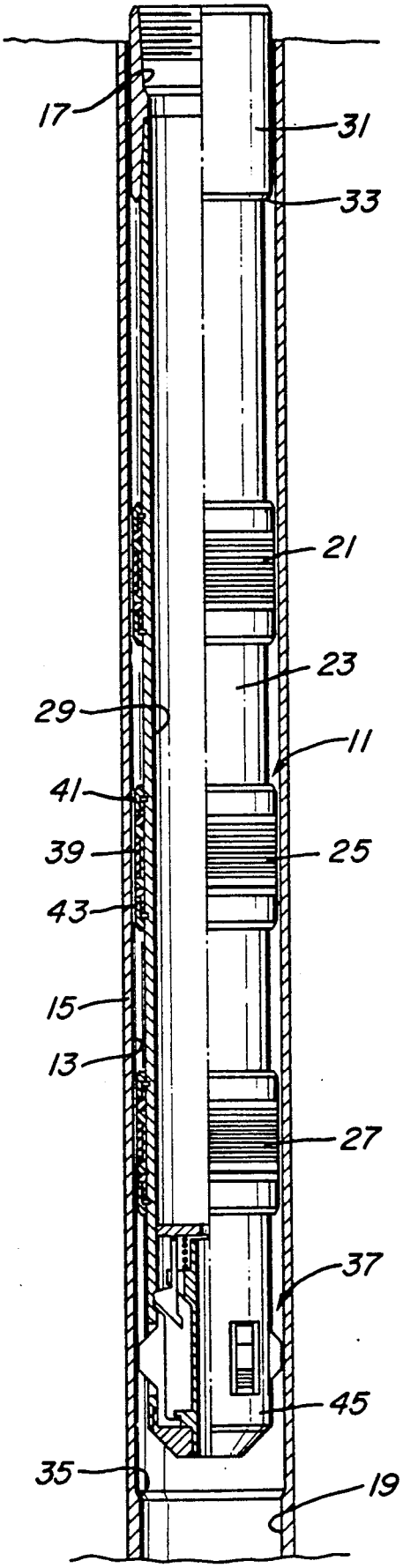
FIG. 1 is a view of one embodiment the lead-in guide assembly of the invention including a quarter-sectional view of the tubular seal carrier being lowered within a surrounding well bore and illustrating the close fit between the seal means thereon and the well casing.

For ease of explanation, the present invention will be illustrated as a seal assembly guide. FIG. 1 shows a seal assembly guide designated generally as 11. The seal assembly guide 11 is used to isolate an annular area, such as area 13 between an oil well casing 15 and a tubing string or fluid transmission conduit and the production zone (not shown). The seal assembly guide 11 includes an internally threaded upper extent 17 for connection in a tubing string leading to the well surface. The annular area extends above the production zone and isolation is provided by means of the interaction between a polished seal bore receptacle 19 which comprises an integral part of the casing, and a seal means 21 which in this case is an elastomeric element which circumscribes a tubular seal carrier 23. In the embodiment shown, there are actually three sets of seal means 21, 25, 27 which are axially spaced along the carrier 23. The tubular seal carrier 23 has a generally open internal bore 29 for the transmission of fluids and communicates by means of the tubing string connected to the threaded extent 17 with the well surface. The tubular seal carrier 23 includes an upper gauge ring 31 with an abutting shoulder 33 for locating the seal carrier at a desired depth within a cooperating sealing bore such as the polished seal bore receptacle 19. The gauge ring 31 comprises a trailing end of the tubular seal carrier.

The polished seal bore receptacle 19 is typically incorporated into the casing string 15 when the casing is first installed in a subterranean oil or gas well. Producing zones would be identified prior to installation of the casing 15 and the polished seal bore receptacle 19 installed just above a producing zone. The receptacle 19 is attached to the casing by a threaded connection. Similar threaded connections located at the lower end of the polished seal bore receptacle provide attachment to those portions of the casing extending below the receptacle. An upwardly facing shoulder 35 is located on the inner surface of the receptacle and is referred to as a no-go shoulder. The downwardly facing shoulder 33 serves to locate the tubular seal carrier 23 within the receptacle. The inner diameter of the polished seal bore 19 is less than the normal inner diameter of the well casing 15. However, this reduction in the diameter of the casing need not be large and would not appreciably change the cross-sectional area of the casing.

At the point at which it becomes desirable to isolate the production zones from the casing by preventing communication of produced fluids between the production zones and the tubing casing annulus, the seal assembly guide of the invention would be inserted into the well on the lower end of a production string (not shown). The seal carrier 23 is lowered until the downwardly facing shoulder 33 encounters the upwardly facing shoulder 35 of the receptacle. The seal means 21, 25, 27 are, in the embodiment shown, seal stacks which comprise a plurality of chevron-shaped sealing elements.

Although various conventional sealing assemblies could be employed with this invention, the particular sealing elements depicted comprise a primary elastomeric sealing member to provide adequate sealing integrity in the presence of high pressure differentials. Such elastomeric sealing elements are known which, for example, utilize a perfluoroelastomer, such as the elastomer commonly referred to under the Dupont trademark "KALRAZ." Each of the seal means, in addition to the elastomeric element 39 also includes relatively rigid backup rings of such material as polyphenylene sulfide, commonly referred to under the Phillips Petroleum Corporation trademark "RYTON" and members formed of polytetrafluoroethylene with glass filler material interspersed therein, commonly referred to as glass filled "TEFLON" a trademark of Dupont Corporation. The chevron-shaped sealing assemblies do not require the application of mechanical compressive force in order to energize the sealing elements and such chevron-shaped members generally have a small radial width. Metal backup rings 41, 43 are also shown between adjacent seal assemblies.

Although the preferred embodiment of FIG. 1 includes at least one elastomeric ring circumscribing the exterior of the tubular seal carrier 23, it will be understood that other tubing seal means such as metal-to-metal seals can be provided circumscribing the exterior of the tubular seal carrier. A suitable metal-to-metal seal means is illustrated at page 62 of the Baker Service Tools 1990 Catalog as the "Metal-To-Metal Tieback Stem."

One problem with the prior art devices has been possible damage to the seal means 21, 25, 27 during the running-in operation. The prior art devices have typically utilized only the gauge ring 31 in order to centralize the tubular seal carrier. The present device includes a guide means 45 located at the leading end of the seal carrier 23. In the position shown in FIG. 1, the guide means 45 is in the fully expanded position and closely fits within the surrounding cased well bore 15. The guide means serves to centralize the seal carrier within the surrounding well bore. As will be explained, the guide means is collapsible between an expanded, running-in position as shown in FIGS. 1 and 2 and a retracted position, shown in FIG. 3, when positioned within the cooperating sealing bore of the polished seal bore receptacle 19.

Figure 2:
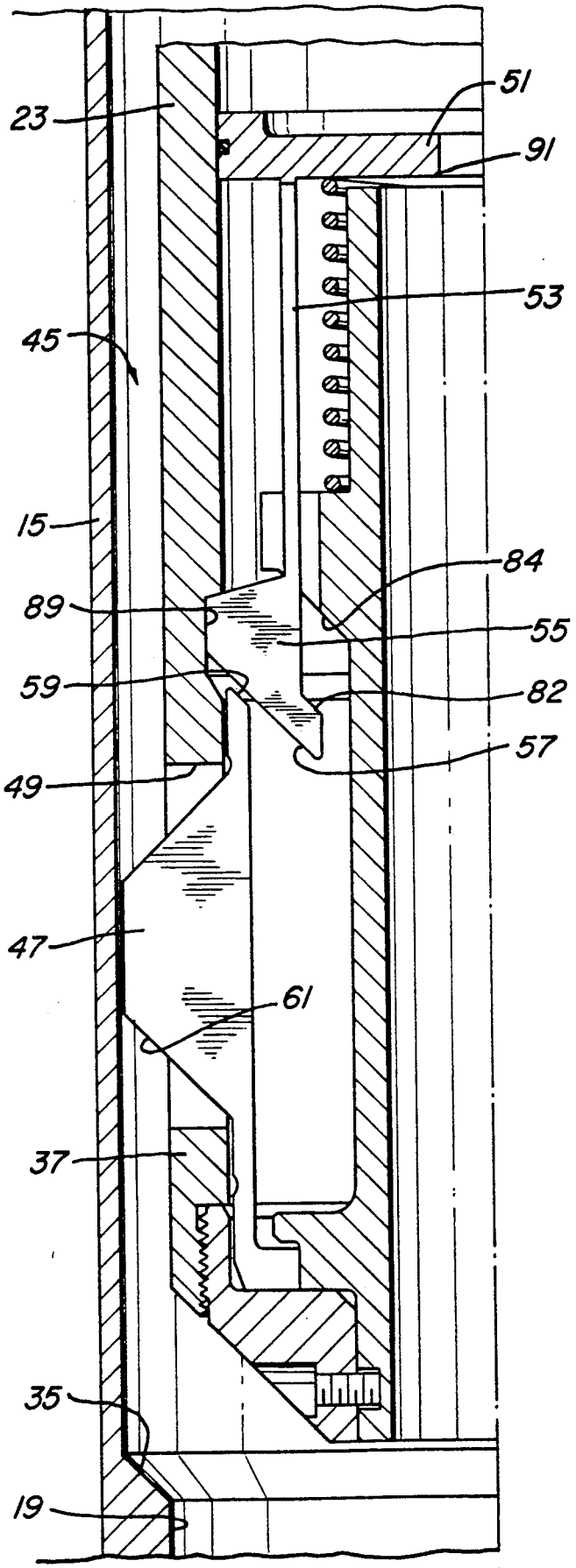
FIG. 2 is an isolated view of the leading end of the tubular seal carrier showing the guide dogs in the expanded position as the lead-in guide assembly moves through the cased well bore and prior to contacting the upwardly facing shoulder of the sealing bore receptacle.
Figure 3:
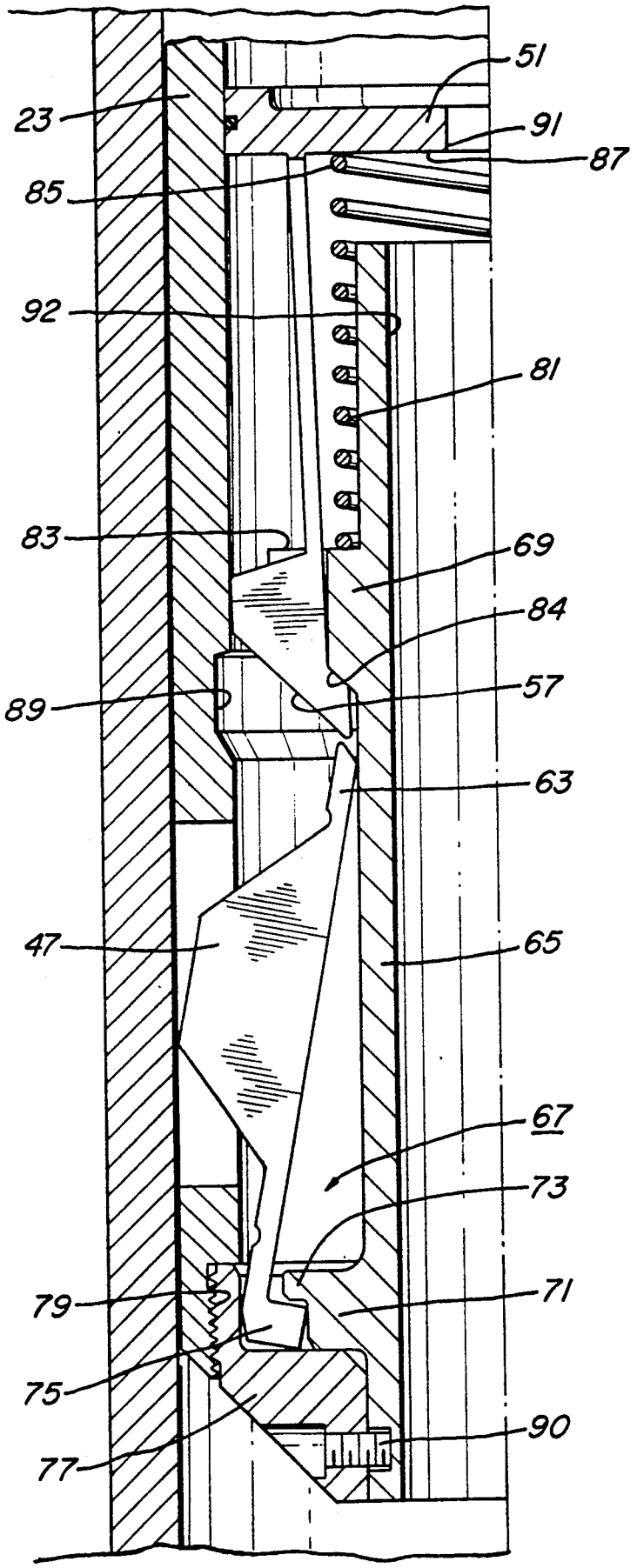
FIG. 3 is a view similar to FIG. 2 showing the movement of the guide dogs to the retracted position as the leading end of the tubular seal carrier passes within the polished seal bore surface of the sealing bore receptacle.

FIG. 2 is a close-up view of one embodiment of the guide means 45 of the invention. Again, the guide means 45 is located within the cased well bore 15 just prior to entering the polished bore surface of the polished bore receptacle 19. The guide means includes a plurality of radially moveable guide dogs 47 which are located at the leading end 37 of the tubular seal carrier 23 within windows 49 located therein. As shown in FIGS. 2 and 3, the guide dogs 47 are radially shiftable between the expanded position shown in FIG. 2 and the retracted position shown in FIG. 3 upon axial movement of the tubular seal carrier within the polished seal bore surface 19 of the casing bore receptacle. The guide dogs 47, as best seen in FIG. 2, are selectively sized to be closely received within the surrounding interior of the cased well bore 15 during the running-in operation. At least selected guide dogs 47 contact the surrounding well bore 15 in order to centralize the seal assembly within the cased well bore. The dogs are moved to the retracted position shown in FIG. 3 upon contact with the upwardly facing shoulder 35 of the casing bore receptacle.

In the embodiment of FIG. 2, the guide means 45 includes a spring loaded collet 51 having a plurality of downwardly extending collet fingers 53. The collet is located within the leading end of the tubular seal carrier 23 with the fingers thereof in contact with the guide dogs 47 for biasing the guide dogs radially outward in the direction of the cased well bore 15 during the running-in operation. The collet fingers 53 include lower extents 55 having inwardly slanting ramp surfaces 57 for contacting a cooperating, oppositely arranged ramp surface 59 provided on each of the associated guide dogs 47. Each guide dog 47, in turn, has an angled surface 61 for contacting the upwardly facing shoulder 35 of the casing bore receptacle 19. Contact between the angled surface 61 of the guide dog 47 and the shoulder 35 causes inward movement of the guide dog and contact between the respective ramp surfaces 59, 57 of the guide dogs 47 and the collet fingers 55.

As shown in FIG. 3, such radial inward movement causes the upper extent 63 of the guide dog 47 to pivot inwardly in the direction of an internal mandrel 65 which comprises a portion of the guide means 45. The recessed area 67 provided between the upper and lower flanges 69, 71 of the mandrel 65 allow the guide dogs 47 to move to the retracted position as the guide dog ramp surfaces 59 travel along the ramp surfaces 57 of the collet 51. The lower flange 71 of the internal mandrel 65 includes a retaining shoulder 73 for engaging a lower extent 75 of the guide dog 47 allowing pivotal movement of the guide dog lower extent 75 between the shoulder 73 and the internal surface of a nose ring 77. The nose ring 77 has an externally threaded surface which, as shown in FIG. 3, engages the internally threaded surface 79 of the leading end 37 of the tubular seal carrier 23.

A coil spring 81 rests upon a shelf 83 formed by the upper flange 69. The coil spring 81 has an opposite end 85 which contacts the lower, internal surface 87 of the collet 51 in order to normally spring-bias the collet upwardly as viewed in FIGS. 2 and 3. As shown in FIG. 2, the lower extents 55 of the collet fingers are received within an internal groove 89 provided within the leading end of the seal carrier 23 when in the running-in position. Contact between the cooperating ramp surfaces 57, 59 causes the collet fingers 53 to flex radially inward, allowing the lower extents 55 to pop out of the associated groove 89. The coil spring 81 then spring-biases the fingers in the upward direction as viewed in FIG. 3 until the collet internal shoulder 82 contacts mating shoulder 84 of the internal mandrel 65. The internal mandrel 65 remains stationary during the described operation, being connected by means of bolts 90 to the nose ring 77.

The collet 51 has a central bore 91 or orifice (FIG. 2) to allow the transmission of fluids through the interior of the guide means. In order to re-cock the mechanism, fluid is pumped from the well surface through the interior of the tubular seal carrier 23 and through the orifice 91 into the interior (92 in FIG. 3) of the internal mandrel 65. A pressure differential of, e.g. 300 p.s.i., across the orifice 91 in the collet top plate 51 pushes the collet downwardly from the position shown in FIG. 3 to the re-set, running-in position of FIG. 2.

The guide means can be formed of drillable materials, such as suitable plastics or soft metals, which can be drilled out of the interior of the tubular seal carrier 23 to provide an open bore within the seal carrier for later operations. The guide means can also be engageable with a retrieving tool (not shown) for removal during later operations.

An invention has been provided with several advantages. The lead-in guide assembly is simple in design and economical to manufacture. When embodied as a seal assembly guide, the lead-in guide of the invention protects the more delicate tubing seals and prevents damage to the seals during the running-in operation. The device is simple in operation and extremely reliable. The device can also be re-cocked from the well surface by circulating fluid through the interior of the tubing string.

While the invention has been shown in only one of its forms, it is not thus limited but is susceptible to various changes and modifications without departing from the spirit thereof.

What is claimed is:

1. A seal assembly guide for centralizing a seal assembly being run from a well surface within a well bore to a cooperating sealing bore located at a downhole location, the seal assembly guide comprising:

a tubular seal carrier having abutting means for locating the seal carrier at a desired depth within the cooperating sealing bore and having external seal means for establishing sealing integrity with the cooperating sealing bore, the tubular seal carrier having a leading end and having a trailing end adapted to be made up in a tubing string leading to the well surface;

collapsible guide means located at the leading end of the tubular seal carrier for centralizing the seal carrier within the surrounding well bore, the guide means being collapsible between an expanded, running-in position while above the sealing bore and a retracted position within the cooperating sealing bore; and wherein the abutment means comprises a downwardly facing no-go shoulder on the tubular seal carrier for engaging a cooperable upwardly facing shoulder provided as a part of the cooperating sealing bore located at the downhole location.

2. A seal assembly guide for centralizing a seal assembly being run from a well surface within a cased well bore to a cooperating sealing bore including a receptacle portion located at a downhole location, the seal assembly guide comprising:

a tubular seal carrier having abutting means for locating the seal carrier with respect to the receptacle portion of the cooperating sealing bore and having external seal means for establishing sealing integrity with the cooperating sealing bore, the tubular seal carrier having a leading end and having a trailing end adapted to be made up in a tubing string leading to the well surface;

collapsible guide means located at the leading end of the tubular seal carrier for centralizing the seal carrier within the surrounding well casing as the tubular seal carrier is being lowered from the well surface, the guide means being collapsible between an extended, running-in position while above the sealing bore and a retracted position within the cooperating sealing bore;

wherein the receptacle portion of the cooperating sealing bore defines a polished seal bore surface and wherein the external seal means on the tubular seal carrier establishes sealing integrity with the polished seal bore surface when the tubular seal carrier is positioned within the cooperating sealing bore; and wherein the abutment means comprises a downwardly facing no-go shoulder on the tubular seal carrier for engaging a cooperable upwardly facing shoulder on the receptacle portion of the sealing bore.

3. The seal assembly of claim 2, wherein the collapsible guide means includes a plurality of radially shiftable guide dogs located at the leading end of the tubular seal carrier, the guide dogs being radially shiftable between the expanded and retracted positions upon axial movement of the tubular seal carrier within the receptacle portion of the cooperating sealing bore.

4. The seal assembly of claim 3, wherein the guide dogs are selectively sized to be closely received within the surrounding cased well bore during the running-in operation at least selected dogs making contact with the well bore during the running-in operation in order to centralize the seal assembly within the cased well bore and are moved to the retracted position upon contact with the upwardly facing shoulder on the receptacle portion of the sealing bore.

5. A seal assembly guide for centralizing a packoff seal assembly being run from a well surface within a cased well bore to a cooperating casing bore receptacle defining a polished seal bore surface located at a downhole location, the seal assembly guide comprising:

a tubular seal carrier having a downwardly facing shoulder for locating the seal carrier with respect to a cooperable upwardly facing shoulder on the casing bore receptacle, the seal carrier having external seal means for establishing sealing integrity with the polished seal bore surface, the tubular seal carrier having a leading end and having a trailing end adapted to be made up in a tubing string leading to the well surface;

collapsible guide means located at the leading end of the tubular seal carrier for centralizing the seal carrier within the surrounding cased well bore as the tubular seal carrier is being lowered from the well surface, the guide means being collapsible between an expanded, running-in position while above the casing bore receptacle and a retracted position within the polished seal bore surface.

6. The seal assembly guide of claim 5, wherein the collapsible guide means includes a plurality of radially movable guide dogs located at the leading end of the tubular seal carrier within window openings provided therein, the guide dogs being radially shiftable between the expanded and retracted positions upon axial movement of the tubular seal carrier within the polished seal bore surface of the casing bore receptacle.

7. The seal assembly of claim 6, wherein the guide dogs are selectively sized to be closely received within the surrounding cased well bore for contacting the well bore during the running-in operation in order to centralize the seal assembly within the cased well bore and are moved to the retracted position upon contact with the upwardly facing shoulder on the casing bore receptacle.

8. The seal assembly of claim 7, wherein the guide means includes a collet having a plurality of collet fingers positioned within the leading end of the tubular seal carrier in contact with selected ones of the guide dogs for biasing the guide dogs radially outward in the direction of the cased well bore during the running-in operation, each of the collet fingers being provided with a ramp surface for contacting a cooperating ramp surface provided on the associated guide dog, whereby contact of the guide dog with the upwardly facing shoulder of the casing bore receptacle allows inward movement of each guide dog ramp surface along each collet finger ramp surface.

9. The seal assembly of claim 7, wherein the guide means is formed of a drillable material which can be drilled out of the interior of the tubular seal carrier to provide an open bore within the tubular seal carrier during later operations.

10. The seal assembly of claim 7, wherein the guide means is engageable with a retrieving tool for removable during later operations.

11. The seal assembly of claim 7, wherein the seal means includes at least one elastomeric ring circumscribing the exterior of the tubular seal carrier.

12. The seal assembly of claim 11, wherein the seal means includes at least one metal-to-metal seal circumscribing the exterior of the tubular seal carrier.

* * * * *